US005247998A

United States Patent [19]

Fallon

[11] Patent Number: 5,247,998

[45] Date of Patent: Sep. 28, 1993

[54] CHIMNEY FIRE EXTINGUISHING APPARATUS

[76] Inventor: Edward C. Fallon, 3895 Dugue Rd., Valois, N.Y. 14888

[21] Appl. No.: 9,026

[22] Filed: Jan. 26, 1993

[51] Int. Cl.[5] ..... A62C 3/04

[52] U.S. Cl. ..... 169/49; 169/54; 169/59; 49/7; 110/193; 126/287.5; 454/4; 454/28; 137/74; 137/75

[58] Field of Search ..... 169/54, 56, 59, 48, 169/49; 126/287.5, 293; 49/1, 7; 454/4, 7, 28; 110/193, 184; 137/75, 74, 543.19

[56] References Cited

U.S. PATENT DOCUMENTS

| | | | |
|---|---|---|---|
| Re. 32,362 | 2/1987 | McCabe | 137/75 X |
| 4,646,847 | 3/1987 | Colvin | 169/49 |
| 4,947,736 | 8/1990 | Koning | 169/57 X |

FOREIGN PATENT DOCUMENTS

| | | | |
|---|---|---|---|
| 250388 | 12/1987 | European Pat. Off. | 169/59 |
| 320071 | 6/1989 | European Pat. Off. | 169/56 |
| 2234501 | 1/1975 | France | 137/75 |

*Primary Examiner*—David M. Mitchell
*Assistant Examiner*—James M. Kannofsky
*Attorney, Agent, or Firm*—Leon Gilden

[57] ABSTRACT

An apparatus arranged to orient a closure cap over an entrance opening of a chimney stack to prevent a fire from projecting through the stack with the apparatus to include a spring-biased member and a fusible link permitting release of a plug member to secure the plug member within the chimney stack upon release of the fusible link.

5 Claims, 4 Drawing Sheets

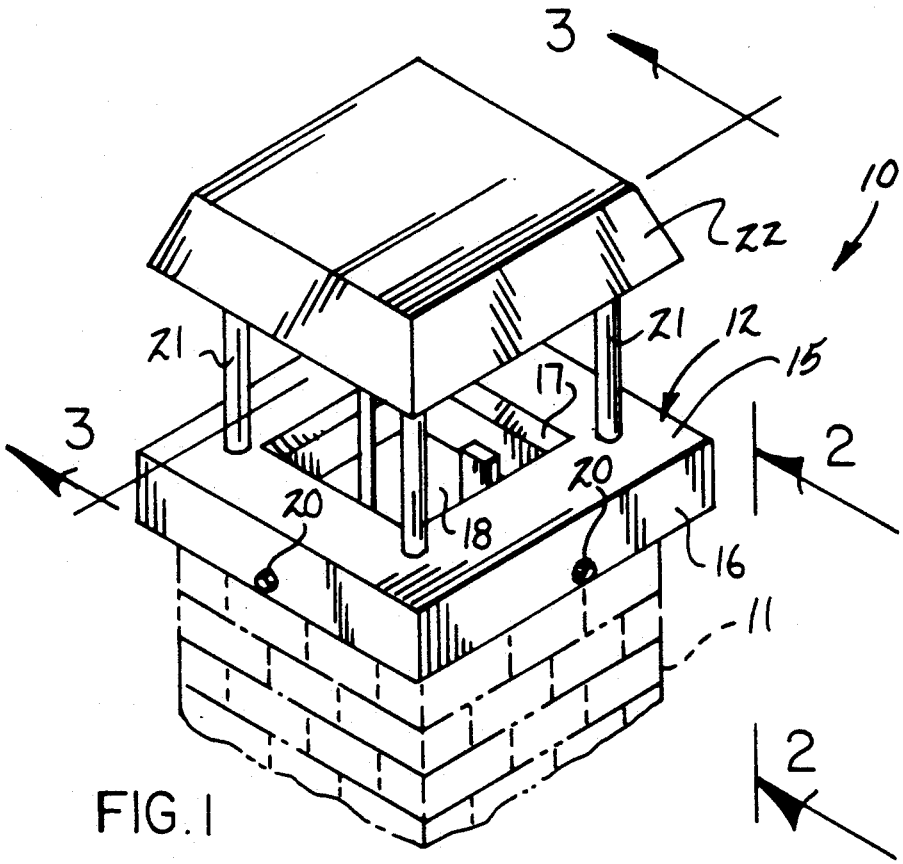
FIG. 1
FIG. 2
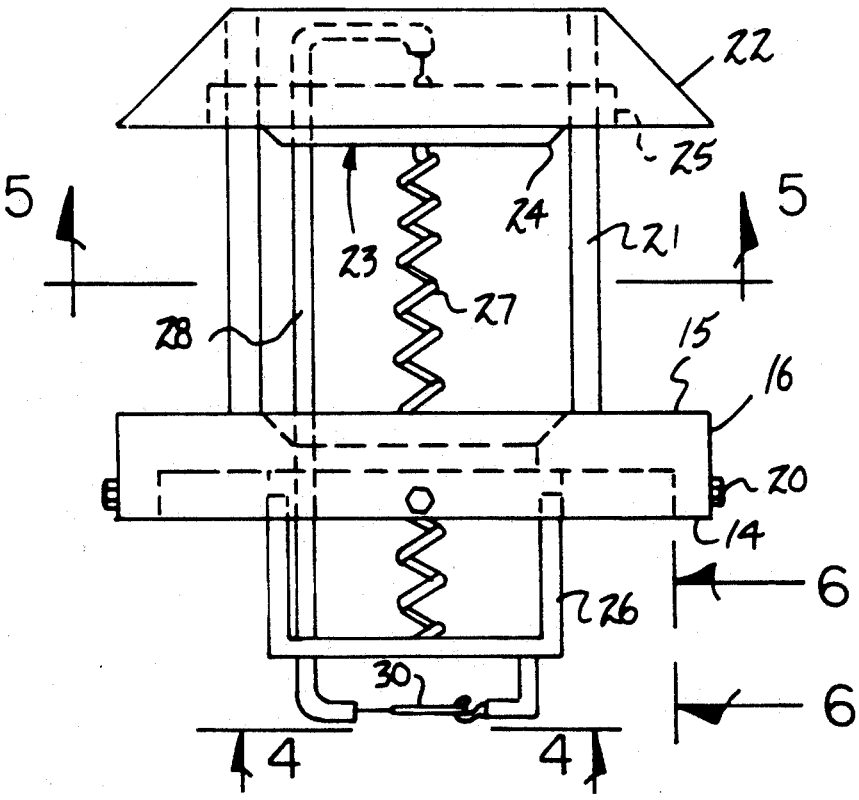

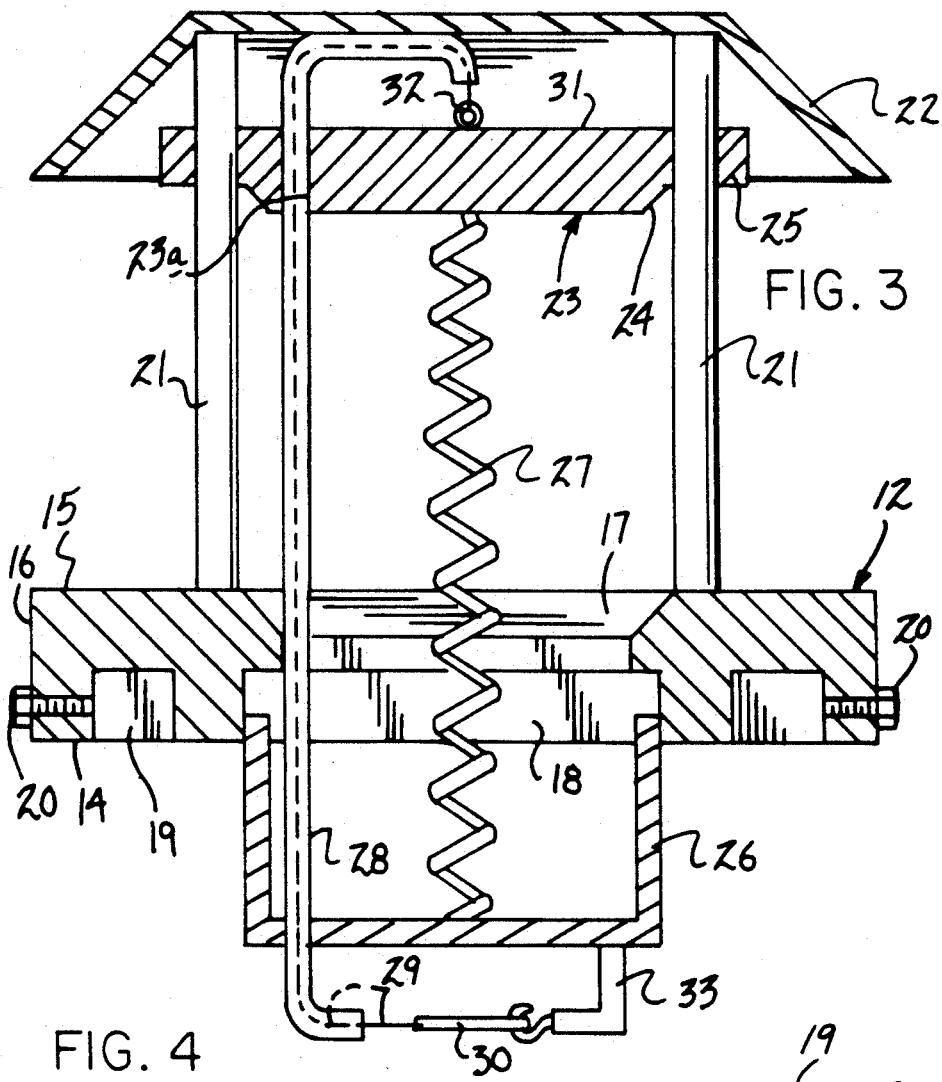
FIG. 3
FIG. 4
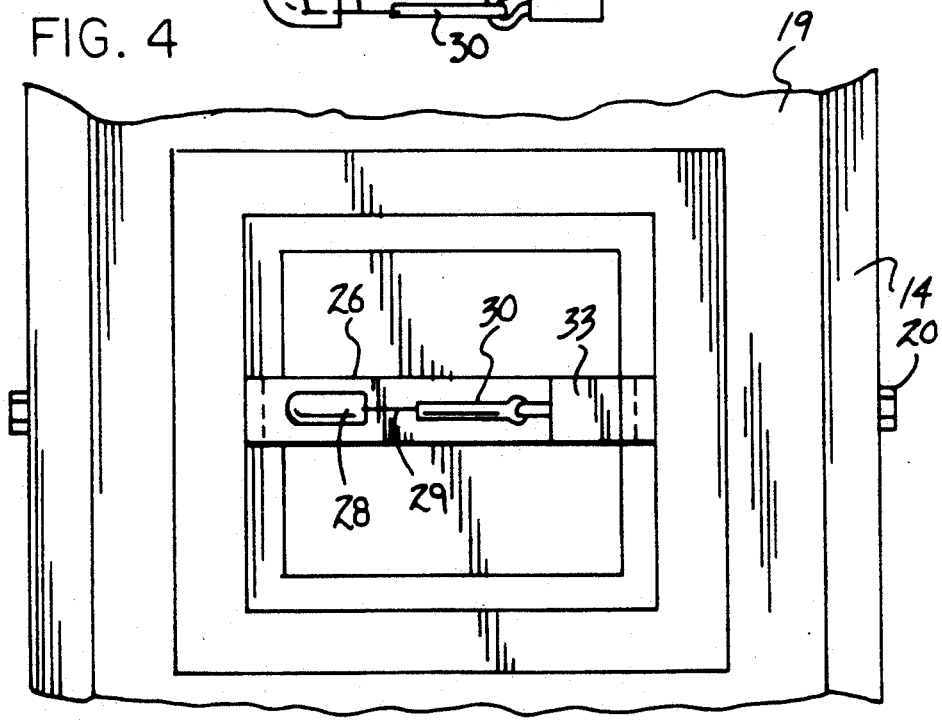

CHIMNEY FIRE EXTINGUISHING APPARATUS

BACKGROUND OF THE INVENTION

1. Field of the Invention

The field of invention relates to chimney fire extinguishing apparatus, and more particularly pertains to a new and improved chimney fire extinguishing apparatus wherein the same is effected to direct a closure cap into a chimney cap opening to effect extinguishing of fire projecting through the chimney stack.

2. Description of the Prior Art

Chimney fire extinguishing apparatus of various types have been utilized throughout the prior art to effect extinguishing of fire within a chimney column such as indicated in U.S. Pat. No. 4,483,315 utilizing a cap and damper to effect closure of fire within a chimney.

Further, chimney fire extinguishing apparatus is exemplified in the U.S. Pat. Nos. 4,736,801; 4,987,958; 4,872,513; and 4,947,736.

The instant invention attempts to overcome deficiencies of the prior art by providing for an organization arranged for ease of use as well as effectiveness in construction in directing a closure cap over a chimney stack to snuff a fire and prevent projection of the fire from the chimney stack and in this respect, the present invention substantially fulfills this need.

SUMMARY OF THE INVENTION

In view of the foregoing disadvantages inherent in the known types of chimney fire extinguishing apparatus now present in the prior art, the present invention provides a chimney fire extinguishing apparatus wherein the same is arranged to project a spring-biased closure cap onto a chimney stack to prevent fire projection from the chimney stack. As such, the general purpose of the present invention, which will be described subsequently in greater detail, is to provide a new and improved chimney fire extinguishing apparatus which has all the advantages of the prior art chimney fire extinguishing apparatus and none of the disadvantages.

To attain this, the present invention provides an apparatus arranged to orient a closure cap over an entrance opening of a chimney stack to prevent a fire from projecting through the stack, with the apparatus to include a spring-biased member and a fusible link permitting release of the plug member to secure the plug member within the chimney stack upon release of the fusible link.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved chimney fire extinguishing apparatus which has all the advantages of the prior art chimney fire extinguishing apparatus and none of the disadvantages.

It is another object of the present invention to provide a new and improved chimney fire extinguishing apparatus which may be easily and efficiently manufactured and marketed.

It is a further object of the present invention to provide a new and improved chimney fire extinguishing apparatus which is of a durable and reliable construction.

An even further object of the present invention is to provide a new and improved chimney fire extinguishing apparatus which is susceptible of a low cost of manufacture with regard to both materials and labor, and which accordingly is then susceptible of low prices of sale to the consuming public, thereby making such chimney fire extinguishing apparatus economically available to the buying public.

Still yet another object of the present invention is to provide a new and improved chimney fire extinguishing apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the invention.

FIG. 2 is an orthographic view, taken along the lines 2—2 of FIG. 1 in the direction indicated by the arrows.

FIG. 3 is an sectional view, taken along the lines 3—3 of FIG. 1 in the direction indicated by the arrows.

FIG. 4 is an orthographic view, taken along the lines 4—4 of FIG. 2 in the direction indicated by the arrows.

DESCRIPTION OF THE PREFERRED EMBODIMENT

Figure 5:
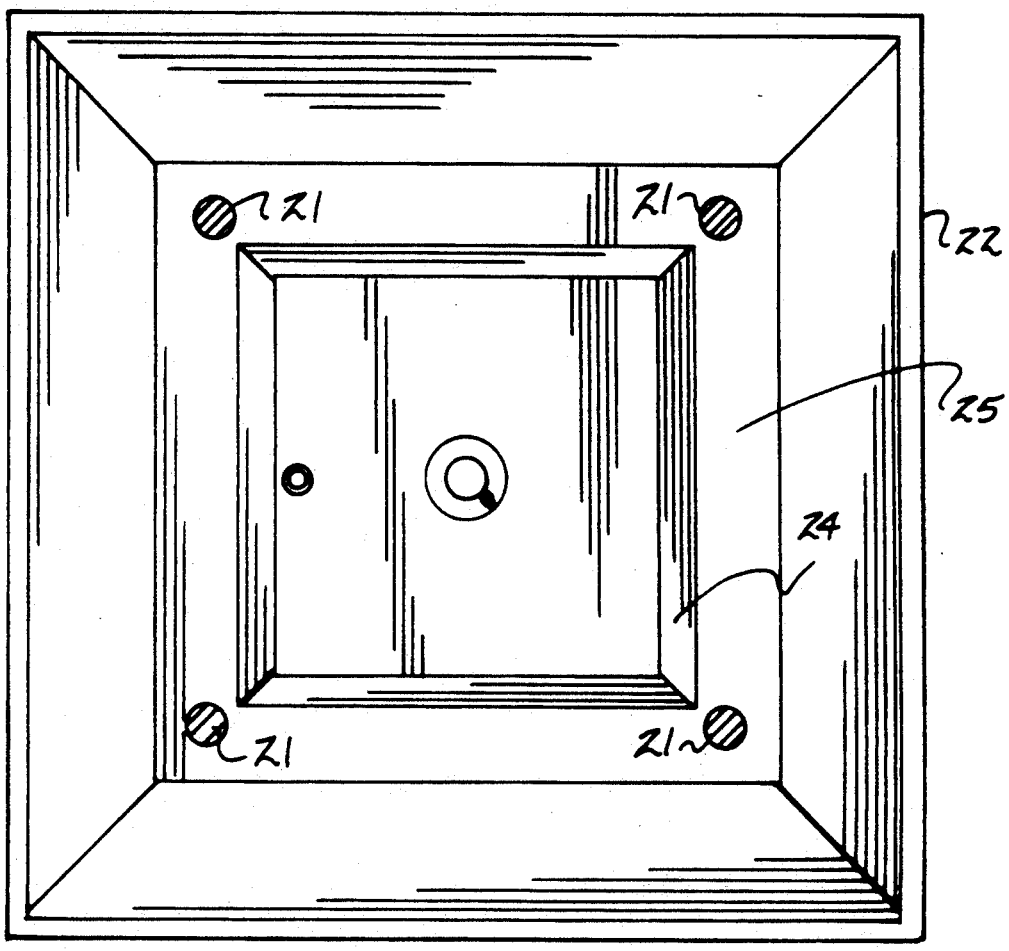
FIG. 5 is an orthographic view, taken along the lines 5—5 of FIG. 2 in the direction indicated by the arrows.
Figure 6:
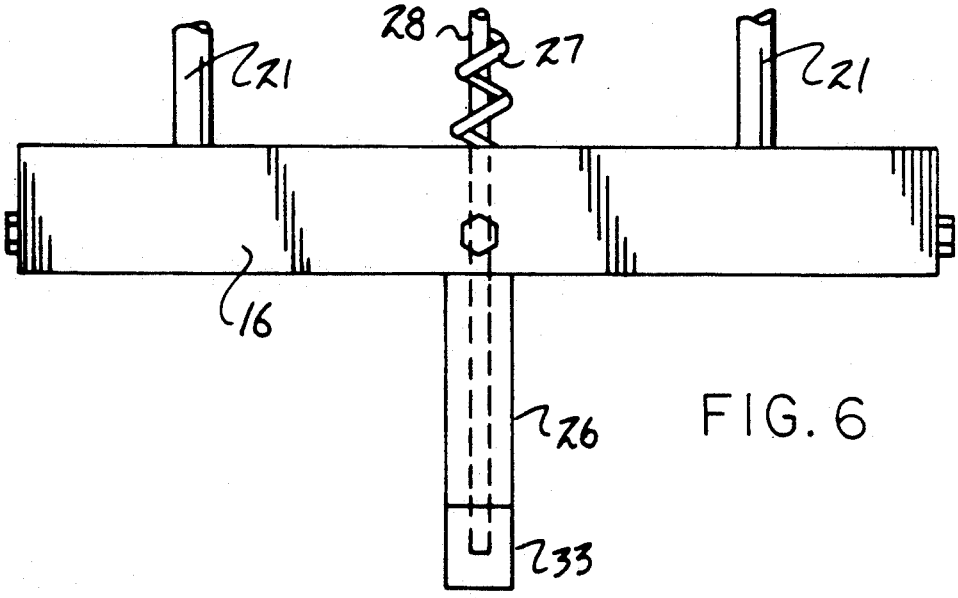
FIG. 6 is an orthographic view, taken along the lines 6—6 of FIG. 2 in the direction indicated by the arrows.

With reference now to the drawings, and in particular to FIGS. 1 to 8 thereof, a new and improved chimney fire extinguishing apparatus embodying the principles and concepts of the present invention and generally designated by the reference numeral 10 will be described.

More specifically, the chimney fire extinguishing apparatus 10 of the instant invention essentially comprises a structure mounted to an upper distal end of a chimney stack 11. The apparatus includes a chimney cap 12 having a cap bottom wall 14 spaced from a cap top wall 15 and a continuous cap side wall 16. The cap includes a cap entrance opening 17 directed into the cap through the top wall 15 medially of the top wall and extending into a cap central opening 18 directed from the cap conical entrance opening 17 to the bottom wall 14. A continuous channel 19 is directed into the cap through the bottom wall in surrounding relationship relative to the cap central opening 18 for receiving the upper distal end of the chimney stack 11. Fasteners 20 directed into the side wall in communication with the channel 19 are arranged for engagement with the chimney stack 11 for securing the chimney cap 12 to the chimney stack 11.

The chimney cap 12 further includes a plurality of rigid guide rods 21 fixedly and orthogonally mounted to the cap top wall 15, with the guide rods of a parallel coextensive relationship relative to one another. A rain cap 22 is fixedly mounted to the guide rods 21 and spaced above the cap top wall 15 and extending in an overlying relationship relative to the cap entrance opening 17.

An entrance opening plug member 23 is slidably mounted, having the guide rods 21 slidably directed therethrough, with the plug member 23 arranged in a spaced relationship between the rain cap 22 and the cap top wall 15. The plug member 23 includes a truncated first portion 24 arranged for complementarily being received within the cap entrance opening 17, with the plug member 23 further having a second plate portion 25 extending laterally beyond the first portion 24 to slidably receive the guide rods 21 therethrough for subsequent abutment onto the cap top wall 15 when the plug member is projected downwardly onto the cap 12, in a manner to be described in more detail below.

A support cradle 26 is fixedly mounted to the chimney cap 12 extending below the bottom wall 14, with the support cradle 26 having a spring member 27 having one end secured to the support cradle 26, with a further end secured to a bottom surface of the plug member 23. A guide tube 28 is provided, with the guide tube fixedly mounted to the support cradle 26 projecting below the support cradle and extending from the support cradle through the chimney cap 12 and subsequently directed to the rain cap 22, with the guide tube 28 having a first end positioned below the support cradle 26, with its second end positioned between the plug 23 and the rain cap 22. The guide tube 28 is slidably received through a plug bore 23*a* through the plug member 23.

A fusible link mounting bracket 33 is fixedly mounted to the support cradle 26 extending therebelow in a spaced relationship relative to the guide tube first end. A fusible link 30 is mounted to the fusible link mounting bracket 33. To the heat sensitive fusible link 30, a support wire 29 is mounted to the fusible link and with the support wire 29 extending through the guide tube 28 and directed exteriorly of the guide tube through the guide tube second end, with the support wire 29 fixedly mounted to a hook 32 that is fixedly secured to the plug member top wall 31. Upon rupture of the fusible link 30 upon sensing of unnecessary heat within the underlying chimney stack 11, the fusible link ruptures releasing the cable first end permitting the cable to be directed through the guide tube 28 and subsequently releasing the plug member 23, whereupon the spring member 27 assists in fixed and immediate projection of the plug member 23 and the truncated first portion 24 into the cap entrance opening 17.

Figure 7:
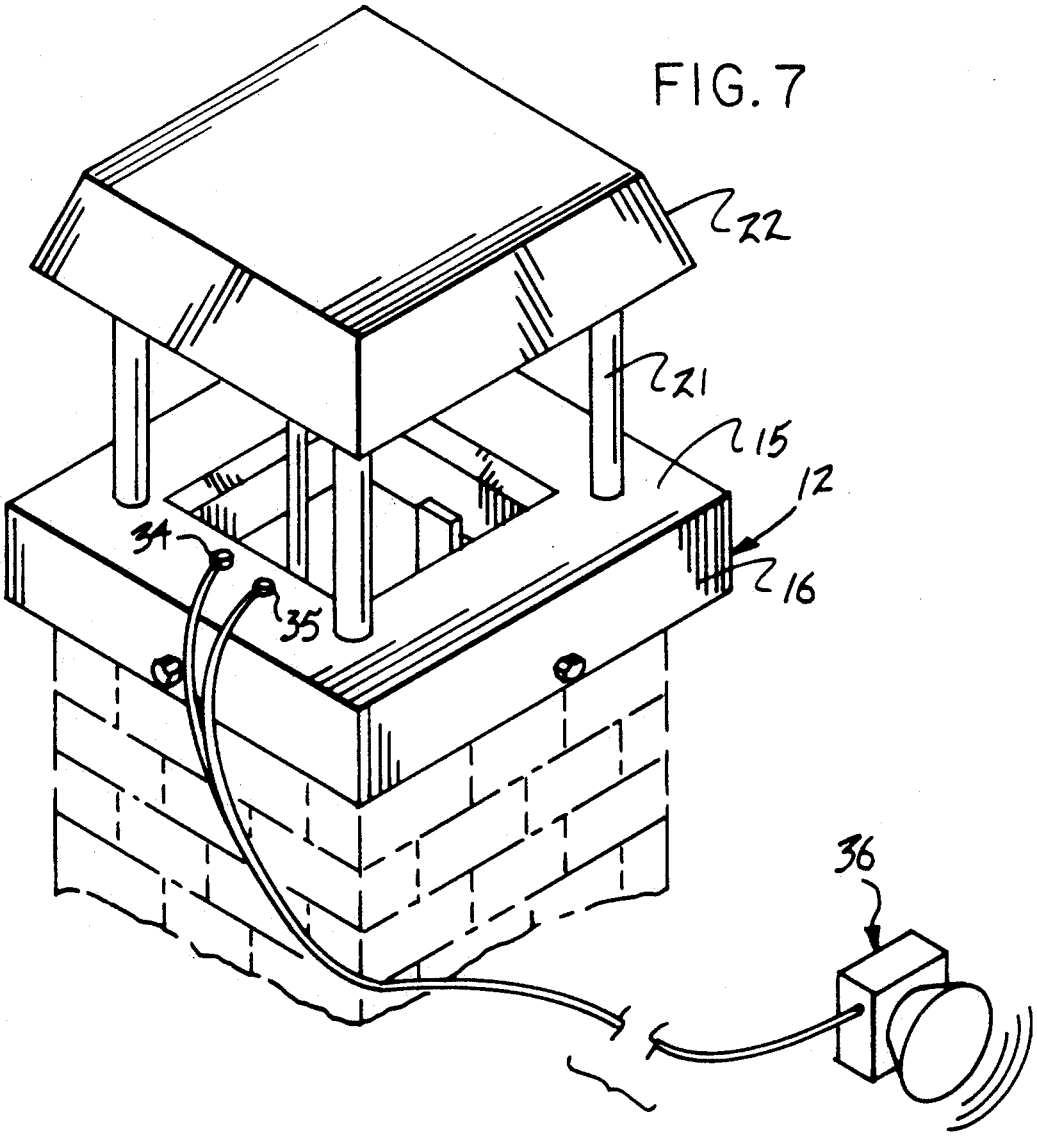
FIG. 7 is an isometric illustration of the invention employing an audible alarm structure.
Figure 8:
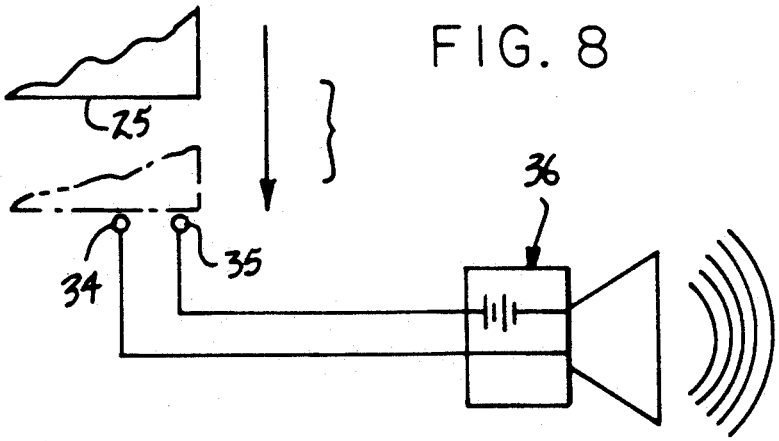
FIG. 8 is a diagrammatic illustration of the audible alarm in cooperation with the plug member.

The FIGS. 7 and 8 includes a chimney cap 12 to further optionally employ first and second electrical contacts 34 and 35 fixedly mounted to the cap top wall 15 between adjacent guide tubes 21. The first and second electrical contacts 34 and 35 are positioned in adjacency to the cap entrance opening 17. Upon release of the plug member 23, in a manner as described above, the cap, upon projection into the cap entrance opening 17, includes the second plate portion 25 engaging the first and second electrical contacts 34 and 35 to complete electrical communication between the first and second electrical contacts and effecting actuation of an alarm housing 36, that includes a battery and speaker assembly to effect an audible alarm of the action of the plug member and associated alarm condition within the chimney stack 11.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A chimney fire extinguishing apparatus arranged for securement to a chimney stack, wherein the apparatus comprises, a chimney cap, the cap having a cap bottom wall spaced from a cap top wall and a cap side wall, with the chimney cap including a cap entrance opening directed into the cap from the cap top wall, with a cap central opening extending through the cap from the cap entrance opening to the cap bottom wall, and a plurality of guide rods fixedly and orthogonally mounted to the cap top wall in a spaced surrounding relationship relative to the cap entrance opening, with a rain cap mounted to the guide rods, with the rain cap arranged in a spaced relationship above the cap top wall, and a plug member, with the plug member having a first portion arranged for reception with the cap entrance opening, and a second portion extending laterally and in surrounding relationship relative to the first portion, with the second portion slidably receiving the guide rods therethrough, and biasing means for biasing the plug member from a first position spaced relative to the cap top wall to a second position, with the plug member received within the entrance opening.

2. An apparatus as set forth in claim 1 wherein the biasing means includes a spring member and a support cradle, the support cradle fixedly mounted to the chimney cap extending below the cap bottom wall, with the spring member having a first end secured to the support cradle, and the spring member having a second end secured to the plug member.

3. An apparatus as set forth in claim 2 wherein the chimney cap includes a continuous channel directed into the cap bottom wall, and a plurality of fasteners directed through the cap side wall in communication with the channel.

4. An apparatus as set forth in claim 3 including a fusible link mounting bracket mounted to the support cradle extending below the support cradle, with a heat sensitive fusible link mounted to the fusible link mounting bracket, and a guide tube, the guide tube having a first end positioned in adjacency to the fusible link, with the guide tube fixedly mounted to the support cradle and extending through the chimney cap, and with the plug member having a plug member bore, and the guide tube slidably received through the plug member bore, and the guide tube having a guide tube second end positioned between the plug member and the rain cap, and a support wire, the support wire having a first end secured to the fusible link, with the support wire directed slidably through the guide tube, and the support wire having a support wire second end projecting from the guide tube second end, and the plug member having a plug member top wall in facing relationship relative to the rain cap, with the plug member top wall including a hook, with the support wire second end secured to the hook, whereupon rupture of the fusible link releases the support wire first end permitting projection of the plug member from the first position to the second position.

5. An apparatus as set forth in claim 4 wherein the cap top wall includes a first electrical contact and a second electrical contact positioned between a plurality of said guide rods, and an alarm housing in a spaced relationship relative to the chimney cap, and the first electrical contact and the second electrical contact in electrical communication with the alarm housing, with the alarm housing including a battery and speaker assembly, and the first electrical contact and the second electrical contact arranged for electrical communication between one another when the plug member is directed into the second position, with the second portion effecting electrical communication between the first electrical contact and the second electrical contact.

* * * * *